United States Patent [19]

Presson

[11] 3,958,856

[45] May 25, 1976

[54] ELECTRICAL WIRING DEVICE

[75] Inventor: Jerry Mayronne Presson, Trumbull, Conn.

[73] Assignee: Harvey Hubbell Incorporated, Bridgeport, Conn.

[22] Filed: Aug. 15, 1975

[21] Appl. No.: 604,906

[52] U.S. Cl. ..... 339/113 R; 339/14 P

[51] Int. Cl.[2] ..... H01R 3/00

[58] Field of Search ..... 339/113 R, 96, 97 R, 339/14 R, 14 P, 195 R, 195 M

[56] References Cited

UNITED STATES PATENTS 3,461,417 8/1969 Schumacher et al. ..... 339/14 P

*Primary Examiner*—Roy Lake
*Assistant Examiner*—DeWalden W. Jones
*Attorney, Agent, or Firm*—Jerry M. Presson

[57] ABSTRACT

Disclosed is a method for "fingerprinting" electrical conductors connected to an electrical wiring device. Also disclosed is an electrical wiring device which allows one to reconstruct the connection of a conductor to at least one device terminal after the conductor is removed from such terminal.

15 Claims, 9 Drawing Figures

FIG. 1
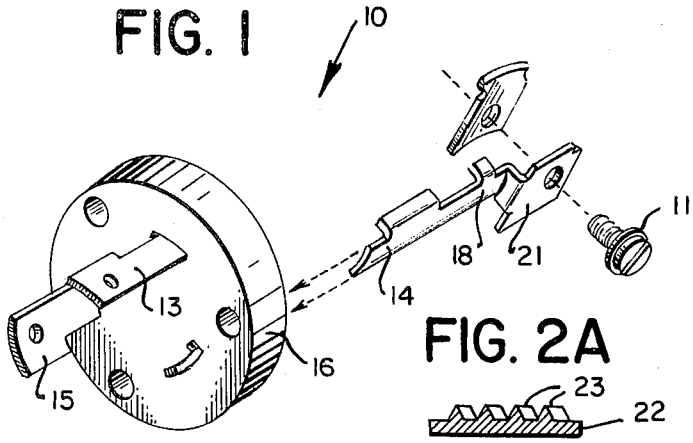
FIG. 2
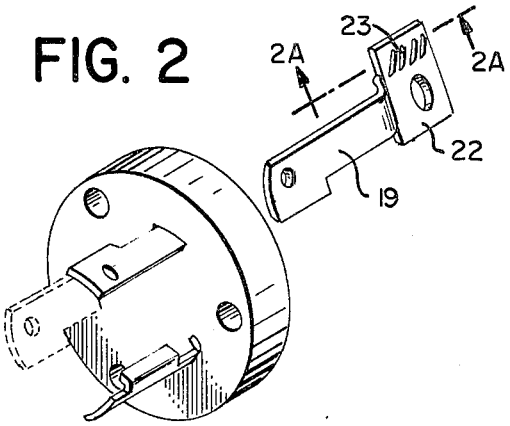
FIG. 2A
FIG. 3
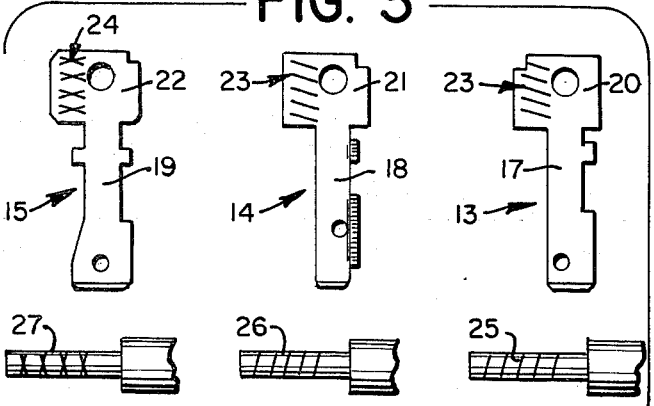
FIG. 6
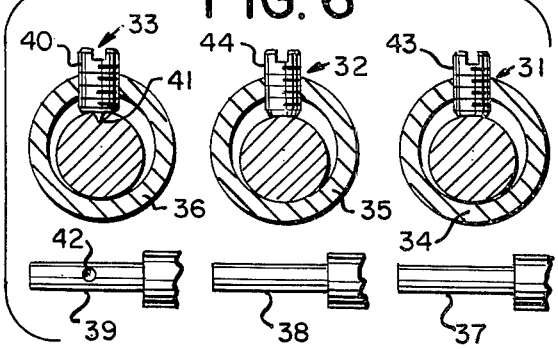
FIG. 4
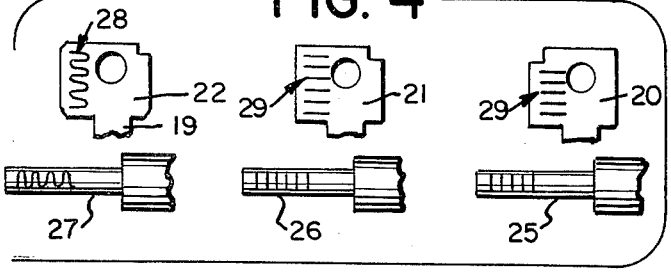
FIG. 7
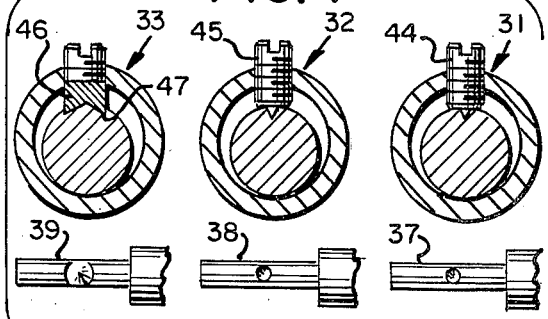
FIG. 5
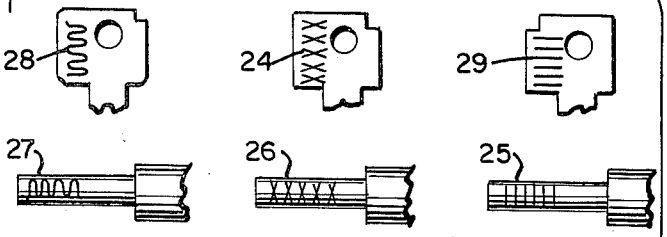
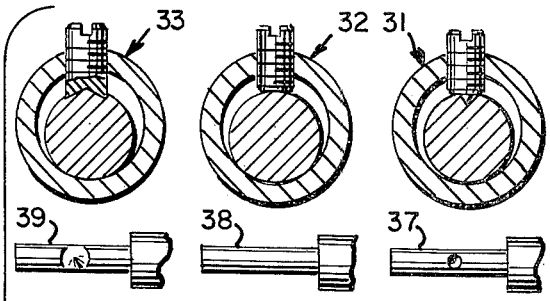
FIG. 8

ELECTRICAL WIRING DEVICE

INTRODUCTION

This invention relates to a method of retracing the wiring connections of an electrical wiring device after the wiring is removed from the device. The invention also relates to an electrical wiring device which permits one to reconstruct prior connections of electrical conductors to the device terminals after the conductors are disconnected from such terminals.

BACKGROUND OF THE INVENTION

Electrical wiring devices such as electrical plugs, receptacles and connectors are electrically connected to the stripped or bare ends of insulated electrical conductors by terminal structures of various designs mounted fixedly within the devices. The individual conductors are typically composed of a material having good electrical conductivity, such as copper or aluminum, and may be of solid cross-section or formed as a compact bundle of individual wires or strands.

It may be desired, in certain instances, to be able to reconstruct the electrical connections to a given wiring device after the conductors are removed. For instance, there may be a need to be able to provide evidentiary proof that a particular electrical connection was or was not made to the device terminals after the conductors have been disconnected from the terminals. At present, it is extremely difficult to reconstruct with any degree of certainty, the connection of any particular conductor to any particular terminal once the conductors are disconnected from the terminals.

OBJECTS OF THE INVENTION

It is an object of this invention to provide a method for reconstructing the wiring of an electrical wiring device after the wiring is disconnected from the device.

Another object of this invention is to provide an electrical wiring device which permits one to reconstruct prior connections of electrical conductors to the device terminals after disconnection of the conductors from such terminals.

Yet another object of this invention is to provide a method and apparatus for reconstructing the electrical wiring of a wiring device with minimal modification of conventional manufacturing techniques and devices.

Still another object of this invention is to utilize oxide breaking means in a wiring device as a means to identify prior connections of electrical conductors to that device.

BRIEF DESCRIPTION OF THE DRAWINGS

The manner in which these and other objects of the present invention are achieved will be best understood by reference to the following description, the appended claims, and the attached drawings wherein:

FIG. 1 is an exploded perspective view of a blade type of wiring device plug having a conventional terminal wiring structure.

FIG. 2 is an exploded perspective view showing the wiring device of FIG. 1 utilizing one embodiment of terminal structure constructed in accordance with the principles of this invention.

FIG. 2A is a partial sectional view taken through the terminal structure of FIG. 2.

FIGS. 3, 4 and 5, respectively, are plan views of different embodiments of terminal plate structures constructed in accordance with this invention.

FIGS. 6, 7 and 8, respectively, illustrate different embodiments of terminal structures for wiring devices of a pin and sleeve type constructed in accordance with this invention.

SUMMARY OF INVENTION

According to one aspect of this invention, there is disclosed a method for determining whether or not an electrical wiring device was correctly wired after the conductors are disconnected from the device terminals. The method comprises forcing into the stripped or bare end of an electrical conductor inserted into a device terminal an indicium representing that terminal at substantially the same time the electrical connection to that terminal is made. Hence, an indelible record is created by the device terminal of the connective relationship created between the conductor and the terminal which survives the subsequent removal of the conductor from that terminal. Such record may be used, for example, to prove or disprove whether the device had been correctly wired before the conductors were removed therefrom.

By selecting the grounding terminal as the terminal to mark any conductor connected thereto, one has a good basis for determining whether or not the conductors were correctly wired to the device.

According to another aspect of this invention, an electrical wiring device is provided with means for marking the conductor which is electrically connected to a device terminal with visually distinguishable indicium corresponding to that terminal of the device. The marking is preferably made indelible so that it is retained by the conductor after removal thereof from the terminal and may be made such by coincidentally imprinting the bare metallic end of a conductor with indicium as the conductor is electrically connected to the terminal.

If so desired, the markings can be effected by providing sharp-edged, oxide-breaking disruptions on one or more terminals with visually distinguishable patterns. In such case, conductor marking is accomplished by the same means which is used to break or penetrate an oxide coating on the conductor.

DETAILED DESCRIPTION OF THE INVENTION

FIG. 1 illustrates a conventional three-blade electrical plug 10 having two nongrounding blades 13 and 14 and a grounding blade 15 mounted fixedly on an electrically insulating base 16 which serves as the front end of the plug. As shown by FIG. 3, terminals 17, 18 and 19 are joined to the innermost ends of the blades 13, 14 and 15, respectively, and these terminals are apertured and internally threaded centrally of their terminal plates 20, 21 and 22 respectively, to receive meshing externally threaded terminal or binding screws 11, FIG. 1. The screws are threaded to engage individual terminal or binding nuts 18. Typically, the heads of the terminal screws and their respective terminals are painted different, standardized colors to facilitate the correct wiring of the device. Generally, the terminal structures and blades are composed of brass or a mixture of metals including brass as a constituent.

After the ends of the conductors which are bare of insulation are inserted and held between the terminal nuts and opposing surfaces of the terminal plates, the terminal screws are turned to drive the terminal nuts and the bare conductor ends into firm engagement with their respective terminal plates thereby effecting electrical connections of the conductor ends to these terminals and hence, to the three blades of the device joined to those terminals.

In accordance with the principles of this invention, as depicted by FIGS. 2 and 2A, the terminal plate 22 of the grounding terminal 19 is provided by means of conventional metal forming operations with raised projections and/or recessed areas. As illustrated, the terminal surface is upset or punched to form a plurality of parallel rows of raised, sharp ridges 23 of generally triangular cross-section with the apices aligned substantially perpendicular to the longitudinal axis of the bare conductor which is to be mounted between the terminal nut and the terminal plate. These ridges may also be used for oxide breaking since the conductor is normally softer than the terminal plate ridges allowing the sharp apices of the ridges to penetrate oxide coating on the conductor. An electrical path to the conductor is also made through the ridges.

With respect to wiring devices which employ terminal plates to make electrical connections to conductors, patterned projections or recesses formed on the plate are utilized as a means for indelibly impressing a desired pattern into any conductor electrically connected to a given terminal. This permits an indelible record to be made of the connections of the conductors to the device terminals after the terminal screws are unloosened and the conductors removed from those terminals. Hence, a conductor may be "fingerprinted" with a visible indicium corresponding to the terminal to which the conductor was previously connected. Unless this indicium is removed by mutilating or severing the conductor, it will remain as an indelible record of a previous connection of the conductor to that particular terminal.

In a three terminal device having two nongrounding or "hot" terminals and one grounding or "ground" terminal, a suitable pattern of sharp projections on the grounding terminal plate and the absence of such on the nongrounding terminal plates will provide a pattern of markings which is of value in retracing the connections to the device. The reason for this is that the device would have been incorrectly wired if the ground conductor, after its removal from the device, is not imprinted with a pattern corresponding to that of the grounding terminal plate whereas, one of the line conductors is so marked. From electrical circuitry considerations, this means that the grounding terminal may have been improperly subjected to electrification by current flow through one of the line conductors. Unintentional and dangerous electrification of any other grounding circuit electrically connected to the grounding terminal of that wiring device could easily have occurred as a result of such improper wiring.

Thus, with reference to FIG. 1, if a line conductor is incorrectly connected to the grounding blade 15, a female receptacle, although properly mated with the plug 10, will receive line voltage on its female grounding contact rather than ground potential. This line voltage will also be carried to any terminal to which the ground conductor of the receptacle is connected and could create a serious hazard to persons or equipment making contact with such terminal. The fact that there may be a reversal between the connections of the line conductors to the non-grounding terminals is normally of no importance because the voltages and currents are normally sinusoidal and hence, undergo polarity reversals every cycle. Manifestly, should it be desired to reconstruct every conductor connection, each terminal may be provided with a distinguishably different pattern of ridges or recesses.

Since the terminal ends of the conductors used with wiring devices may take various forms, such as solid, stranded or stranded with a solid terminal member crimped thereto, it is usually preferred that the terminal provide a distinguishable mark for various types of conductor ends. Using conventional metal forming processes such as upsetting, embossing, coining, punching or stamping the conductor contacting surfaces of the terminal plates can be provided with a plurality of laterally spaced-apart, transverse rows of sharp ridges and/or recesses having edges which can bite into and sufficiently indent the softer conductor ends. Such edges work well with all of these various types of conductors since they are transverse to the longitudinal axis of the conductor or conductors as in the case of stranded wire conductors. Moreover, by providing a different predetermined lateral spacing between adjacent rows of edges on each terminal, it is possible by measuring the separation between the corresponding marks on a conductor and comparing such with the separations between the edges formed on two or more terminals to determine with good degree of certainty the particular terminal to which the conductor which was previously connected.

The conductor marking indicium on the terminal plates may have various patterns and combinations of patterns. For example, as illustrated by FIG. 3, the terminal plate 22 of the grounding blade 19 is designed to have a overall cross-hatched pattern of sharp ridges 23 whereas both terminal plates 20 and 21 of the nongrounding terminals 17 and 18 are respectively designed to have patterns of ridges 23 similar to that described for the terminal 22. A conductor pressed tightly against the cross-hatched pattern of ridges 24 on the plate 22 in the process of being electrically connected to the terminal will be visibly indented by the ridges, and part of the cross-hatched pattern 24 will be impressed into the surface of the conductor 27 thereby visually distinguishing that conductor from the conductors 25 and 26 pressed against the rows of parallel ridges 23 on the terminal plates 20 and 21, respectively.

FIG. 4 illustrates a terminal structure 19 wherein the surface of terminal plate 22 is formed with a continuous sharp ridge 28 of sinusoidal or serpentive configuration. The terminal plates 20 and 21 of the other two terminals are patterned as parallel juxtaposed ridges 29. The ridge defining the serpentine pattern 28 on the plate 22 has an axis of symmetry which will be in substantial coalignment with the longitudinal axis of the bare conductor 27 inserted into the terminal to overlying relationship to the terminal plate 22. The peak-to-peak distance between successive undulations in a plane perpendicular to the axis of symmetry should be not greater than the outer diameter of the bare conductor end 27 overlying the configuration and preferably is much less than this dimension. This will ensure that the pattern impressed into that conductor end will include at least some of the curved peak portions of the configuration to render the impressions readily distinguishable from the rows of linear indentations which will be impressed into the conductors 25 and 26 by the terminal plates 20 and 21, respectively.

FIG. 5 illustrates a possible combination of the three different patterns of surface projections which are applied to the three terminal plates. With this embodiment, each terminal plate will bear a different pattern of indicium allowing all conductors to be indelibly "fingerprinted" by the terminals to which they are electrically connected.

As an alternative to having the terminal plates bearing the indicium imprinting means, in cases where the terminal nut or equivalent part of the terminal engaging the terminal or binding screw does not rotate appreciably while compressive force is being applied to the bare conductor end by that element, this element of the terminal may be serrated or indented to provide the desired pattern on the surfaces of the conductor contacted thereby. For certain applications, it may be desired to provide indicium on both the terminal plate and the element or so that opposite surfaces of the conductor are marked when the connection is made to the terminal. The patterns may be complimentary or different for the element and for the associated terminal plate and in a given device also may be different for each terminal. Other possible variations will be apparent to those skilled in the art.

The invention may also be utilized by other types of wiring devices, such as electrical receptacles. Numerous types of receptacles employ wiring terminal plates which are joined to female contacts. In many cases, the terminal plates mounted on receptacle contacts are of similar size and shape to the terminal plates mounted on the blades of plugs.

Hence, the same process and apparatus employed to form patterns of surface disruptions on the terminal plates of blades may be used to create similar patterns on similar terminal plates of female contacts.

The principles of this invention also may be utilized by electrical connectors of the pin and sleeve type. In this type of wiring device elongated, electrically conductive metallic pins are mounted on the male or pin device and elongated electrically conductive metallic sleeves are mounted on the female or sleeve device; the electrical connection being effected by inserting the pins into corresponding sleeves. Conventional terminal structures are comprised of short lengths of metallic cylindrical collars having good electrical conductivity mounting one or more screws positioned orthogonally with respect to the longitudinal axis of the collar. The collars are hollow and have a large enough internal diameter to accomodate the bare conductor ends inserted therein. The screws are threadedly mounted in the collars and when rotated in one direction, advance axially inwardly to force the inserted ends into firm electrical contact with opposite internal collar wall surfaces. In most cases, the conductor ends are solid, short lengths of bare metal having good electrical conductivity, such as copper or aluminum, of generally circular cross-sectional shape and therefore it is a relatively easy matter to indelibly mark the surface of the conductor ends by providing conical tips to the ends of certain ones of the terminal screws. Identification of any given conductor is made possible by mounting different numbers of screws in prescribed positional relationships on one or more of the collars and/or by uniquely designing the contact tips of the terminal screws so as to take good advantage of the rotational action of the screw tip against the surface of the bare conductor in contact therewith. Accordingly, for a given terminal, the terminal screws may be designed to indelibly mark a conductor surface with a pattern of indentations which uniquely represents the electrical connection of that conductor to that terminal of either, or both, of the pin and sleeve devices as they are rotated in a direction that forces the conductor end against the collar.

FIGS. 6, 7 and 8 are respective sectional end views taken through the hollow, cylindrical sleeve and with terminal screws forming a terminal of a conventional type of pin and sleeve connector for use with conductors of solid cross-section.

In accordance with the embodiment depicted by FIG. 6, a plurality of terminals 31, 32 and 33 of a pin and sleeve receptacle or plug are comprised of three sleeves 34, 35 and 36, respectively, for accommodating three bare conductor ends 37, 38 and 39, respectively, which are also shown in partial side elevational views directly below their respective terminals 31, 32 and 33 following removal from those terminals. To distinguish the electrical connection to the terminal 33, for example, from that of the terminals 31 and/or 32, the terminal screw 40, threadedly mounted in the wall of the sleeve 33 with its axis of rotation perpendicular to the longitudinal axis of the sleeve 33 has its conductor-contacting end formed into a conical point 41. The point 41 will leave a cone-shaped, indelible indentation in the surface of the conductor 39 after an electrical connection is effected between the terminal 33 and the conductor 39. This indentation will remain in the conductor after its disconnection from the terminal so as to distinguish the connection of conductor 39 to the terminal 33 from the connection of the conductors 37 and 38 to a terminal of the device other than the terminal 33 since these latter connections utilizing conventional terminal screws 43 and 44 will not leave readily distinguishable indicium on a conductor connected thereto.

FIG. 7 shows another embodiment wherein the terminal screws 44 and 45 are similar to the screw 40 in FIG. 6 and thereby leave conical indentations in conductors 37 and 38 connected to these conductors. The tip of the terminal screw 46 is concave leaving a circular sharp rim 47 which will produce distinguishable semicircular marks on the surface of the conductor 39 connected to that terminal.

FIG. 8 illustrates a combination of terminal embodiments for a pin and sleeve device providing a positive indication of the connections of the conductors 37 and 39 to the terminals 31 and 33, respectively. It follows that the conductor 38 was connected to the terminal 32.

As described above in connection with the terminal plate embodiment of this invention, if so desired, the inner wall of one or more of the sleeves 34, 35 and 36 may also, or alternatively, be provided with ridges, embossments, indentations and the like for indelibly marking contacting surfaces of one or more of the conductors 37, 38 and 39.

While preferred embodiments have been shown and described, it is to be understood that numerous changes can be made without departing from the spirit and scope of the invention, as set forth herein and in the appended claims.

I claim as my invention:

1. The method of reconstructing the wiring of an electrical wiring device having a plurality of terminals with electrical conductors after the conductors are disconnected from the device, comprising the steps of:

electrically connecting each conductor end to a different terminal, and marking the conductor end connected to one of the terminals with indicium distinguishing the one terminal from the other terminal.

2. The method of determining if an electrical wiring device having at least one normally nongrounded terminal and a normally grounded terminal has been correctly wired with electrical conductors, comprising the steps of:

inserting one end of each conductor into a different terminal, electrically connecting one end of each conductor to the terminal in which the conductor is inserted, impressing indicium unique to the grounding terminal into the end of the conductor substantially at the same time the conductor is being connected to the grounding terminal, whereby the connection of the conductor to the grounding terminal is distinguishable from the connection of the other conductor to the nongrounding terminal.

3. The method of reconstructing the wiring of an electrical wiring device having a plurality of terminals with electrical conductors once the conductors are removed from the terminals, comprising the steps of:

positioning one end of each conductor into a different terminal, forcing a portion of one terminal and one end of the conductor positioned therein into electrical contact, and simultaneously forcing into the one conductor end a distinguishable marking representing said one terminal of the device.

4. The method according to claim 3 and further comprising the steps of forcing into each conductor end a mutually distinguishable marking, whereby each conductor may be identified with the device terminal to which it was connected upon removal thereof.

5. An electrical wiring device for providing electrical terminations to different electrical conductors in a plurality of device terminals, means on one of the terminals for forcing a part of one of the electrical conductors and the one terminal into electrical contact, the forcing means including means for marking the one conductor with indicium which represents only one terminal substantially as electrical contact is effected therebetween, whereby the one conductor is subsequently identifiable as having been connected to said one terminal.

6. The wiring device as claimed in claim 5 wherein the forcing means comprises a screw device mounted for rotation on the one terminal.

7. The wiring device as claimed in claim 6 wherein the forcing means includes a terminal element threadedly engaging said screw device and displaceable toward said one conductor in the device terminal upon rotation of said screw device in one direction and wherein the marking means is carried by said terminal so as to engage the one conductor.

8. The wiring device as claimed in claim 6 wherein the marking means comprises a projection on one end of the screw device which engages the surface of said one conductor.

9. The wiring device as claimed in claim 8 wherein the forcing means comprises at least two screw devices mounted for rotation on the one terminal in juxtaposed relationship with a predetermined distance therebetween, and wherein the other device terminal has a different number of screw devices for engaging a conductor in said other terminal.

10. An electrical wiring device having at least two nongrounding and one grounding terminal for providing electrical terminations to different electrical conductors comprising:

a screw actuated device on each terminal for forcing an elongated end of a different electrical conductor and a conductive surface of each terminal into mutual electrical contact, means on the conductive surface of said grounding terminal for impressing indicium into one conductor end substantially as electrical contact with said surface is effected, the indicium on said means being unique to said grounding terminal whereby said one conductor is identifiable upon removal thereof from the device terminals.

11. The wiring device as claimed in claim 10 wherein said means comprises a first pattern of sharp projections formed on said conductive surface.

12. The wiring device as claimed in claim 11 wherein the first pattern comprises a plurality of rows of serrations oriented to intersect the conductor end transversely thereof.

13. The wiring device as claimed in claim 10 wherein at least one nongrounding terminal includes indicium impressing means on the conductive surface thereof comprising, a second pattern of serrations, the second pattern being visually distinguishable from said first pattern, whereby a conductor connected to said one nongrounding terminal is distinguishable from the conductor connected to the grounding terminal.

14. The wiring device as claimed in claim 10 wherein both nongrounding terminals includes distinguishably different indicium impressing means on the conductive surfaces thereof.

15. The wiring device as claimed in claim 14 wherein the indicium impressing means comprises, second and third patterns of rows of projections formed on the respective conductive surfaces.

* * * * *